United States Patent [19]

Johnsen

[11] 4,143,515

[45] Mar. 13, 1979

[54] CONVERTING FOSSIL FUEL AND LIBERATED WATER CONSTITUENTS TO ELECTRICAL ENERGY, SYNTHETIC NATURAL GAS OR MISCELLANEOUS HYDROCARBONS WHILE AVOIDING BEFOULMENT OF ENVIRONMENT

[76] Inventor: Carsten I. Johnsen, Sandvigen, Arendal, Norway

[21] Appl. No.: 781,013

[22] Filed: Mar. 24, 1977

[51] Int. Cl.[2] ..... F01K 23/00

[52] U.S. Cl. ..... 60/648; 60/39; 60/18 B; 204/DIG. 4

[58] Field of Search ..... 60/39.12, 39.18 B, 648, 60/670; 48/197 R, 206, 202, 215; 204/DIG. 4

[56] References Cited

U.S. PATENT DOCUMENTS

| | | | |
|---|---|---|---|
| 2,614,915 | 10/1952 | Hirsch | 60/39.12 X |
| 3,180,813 | 4/1965 | Wasp et al. | 204/DIG. 4 |
| 3,868,817 | 3/1975 | Marion et al. | 60/39.12 X |
| 3,882,671 | 5/1975 | Nebgen | 60/39.12 X |

*Primary Examiner*—Allen M. Ostrager
*Assistant Examiner*—Stephen F. Husar

[57] ABSTRACT

An abstract of my disclosure envisions a continuously repeated series of treatments a gaseous and fluidized powder stream is subjected to after it is made and unceasingly renewed from fossil fuel, oxygen and steam in a gasifier at slagging temperatures; and then impelled to flow through connected steam making, processing and electricity generating units forming a closed circulatory system; producing a stream of carbon monoxide and hydrogen while generating electrical energy.

4 Claims, 2 Drawing Figures

Figure 1:
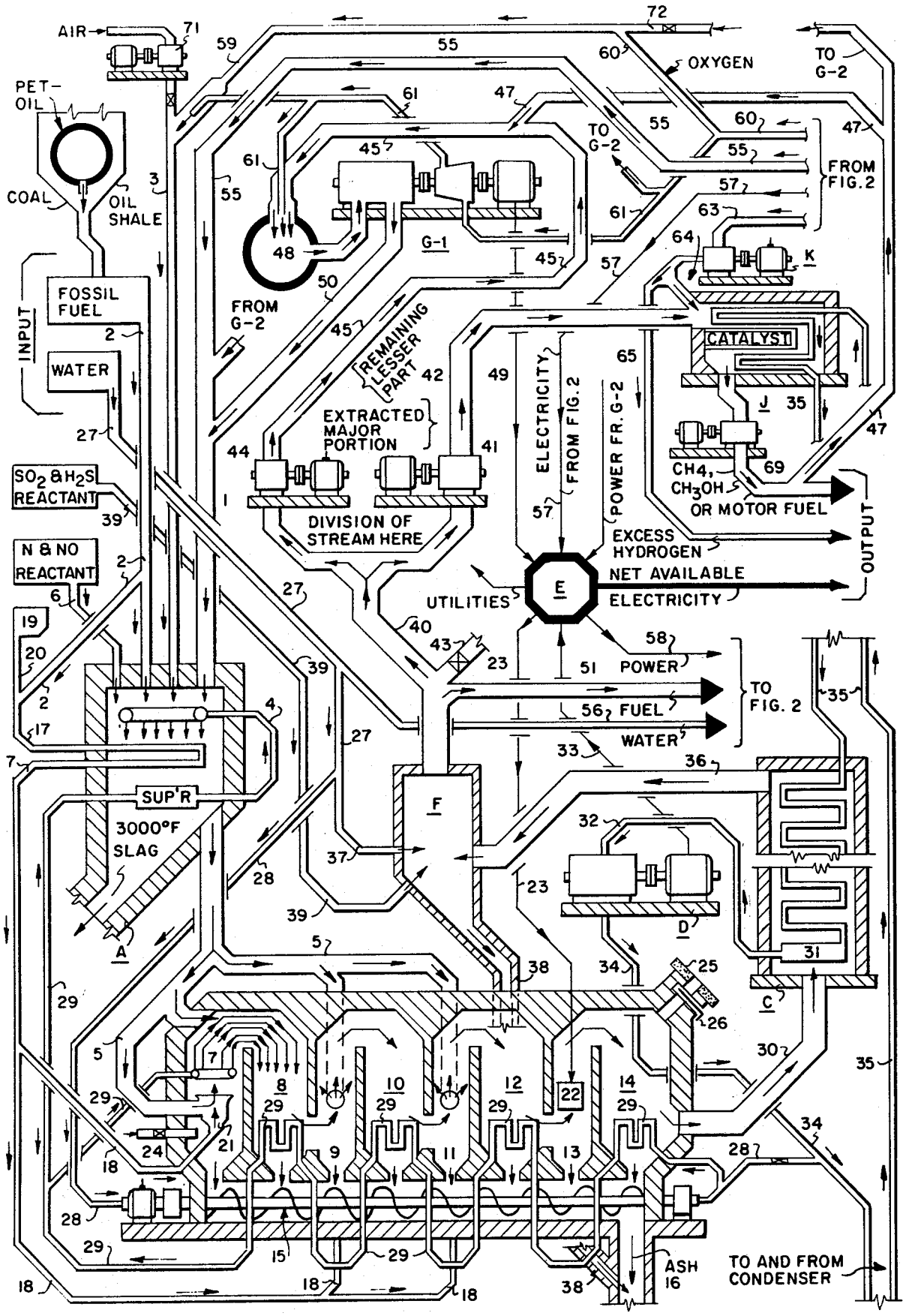

CONVERTING FOSSIL FUEL AND LIBERATED WATER CONSTITUENTS TO ELECTRICAL ENERGY, SYNTHETIC NATURAL GAS OR MISCELLANEOUS HYDROCARBONS WHILE AVOIDING BEFOULMENT OF ENVIRONMENT

In view of the continuous renewal of the stream, extraction of an equivalent processed gas portion, equal to the mass of ingredients absorbed by the stream, is an obvious necessity to maintain mass equilibrium and continuity of processing in the closed circulatory system, the extracted portion being diverted from the stream to separate processing, arriving at useful, soleable products in quantity, substantially improving overall disclosure economies.

For the above series of treatments requiring much oxygen and hydrogen, I provide Electrolyzer-Fuelcell Combinations receiving power from said disclosure embodiment energizing water-immersed-electrodes, causing oxygen and hydrogen to rise therefrom in separate passages to useful employment; while simultaneously activating intimately associated fuel cells, fueled by fuel gas portions also diverted from the same embodiment, such combination of electrolyzer and fuel cell in the same apparatus generating electricity caused to contribute to the energizing of the said water-immersed-electrodes thereby substantially reducing power withdrawals from the disclosure embodiment; the partially spent fuel cell discharges directed to the gasifier, completing a circuit of the closed circulatory system.

Much of the electrical energy consumed as of now is being generated by burning fossil fuel with air under boilers making steam for heat engines driving electric generators; the products of combustion therefrom are then disposed of via boiler stack thus befouling the atmosphere with obnoxious and biologically injurious discharges, having in addition undesirable climatics effects as well as being wasteful of valuable fuel resources, now in short supply.

Compared to that, my invention will do much to rectify the above named deficiencies characterizing conventional thermal power plants; principal differences are that in my disclosure an unceasingly renewed fossil fuel and steam based synthesis gas stream is not discharged befouling the environment as in related methods, but in retained within the disclosure embodiment and passed therein through its processing and electricity generating units; continuity being assured by continuous extraction of adequate stream portions directed to useful employment or separate processing; while remaining stream portions are caused to flow over and over again through additional units of the embodiment, therefrom joining the said unceasingly renewed stream, thus completing a circuit of the closed circulatory system; a novel feature of my disclosure, repeated indefinitely if desired.

Such a plant will have a ratio of output to input of 45–48% compared to 35–38% for the best convential thermal electricity generating stations in U.S.A., the Carnat Limitation for heat engines fulfilled as before in operating enbodiments of my disclosure. In view of said high fueling efficiency, I estimate that 35% less fossil fuel will be needed when using my method, absorbed steam and oxygen taking its place.

Another valuable feature of my invention not found elsewhere is its degree of operating flexibility to demand for emergency power, or for more or less of one or the other of its products; met without alterations or additions to its embodiment, but merely by value opening or closing, or the pressing of control buttons.

Figure 2:
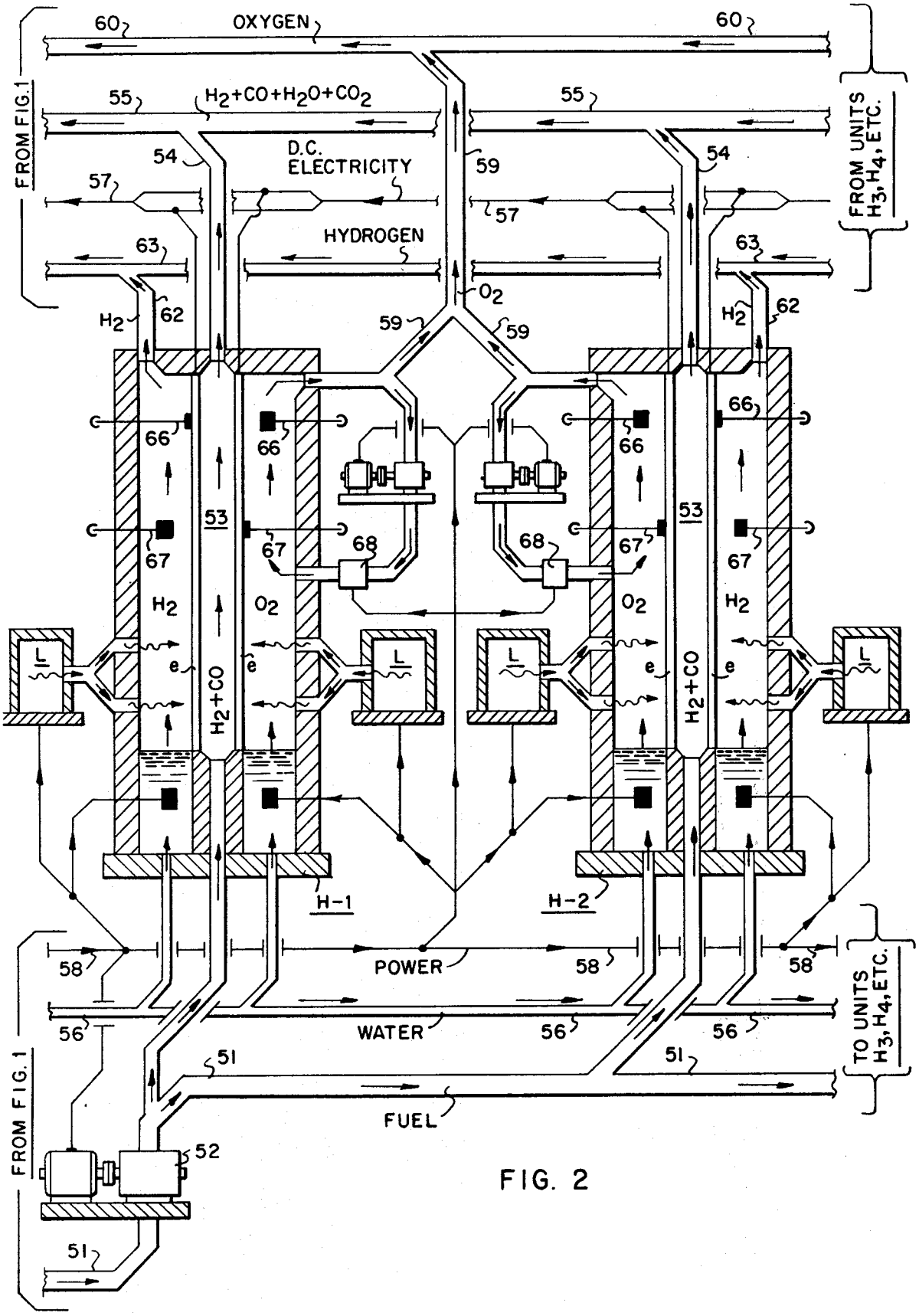

My invention is diagrammatically illustrated in broad outlines by the two accompanying drawings, FIGS. 1 and 2; arrow heads indicating direction of flow of the continuously renewed gaseous stream, through units shown to "output" at right hand margin of FIG. 1, while Electrolyzer-Fuelcell Combinations are detailed on FIG. 2.

In a brief outline of my invention, a first step is the continuous replenishing of the circulating gaseous stream by gasifying fossil fuel with oxygen and steam in gasifier A at slagging temperatures, making synthesis gas at about 3000° F.

The hot gaseous stream out of A is directed to B wherein carbon dioxide and steam are reacted with added carbon, for example coke, to carbon monoxide and hydrogen while shedding and ejecting ash; a still quite hot stream of mostly carbon monoxide and hydrogen plus sulphur dioxide issuing from B enters steam boiler C making steam for a heat engine-electric generator set D, electrical energy to the central electricity control station E for distribution, the cooled gaseous stream issuing from C is next directed to unit F in drawing wherein sulphur dioxide, hydrogen sulphide and steam are caused to combine with effective reactants to non-gaseous products, outseparated from the stream for ejection from embodiment along with ash from B.

A first portion of the stream out of F consisting of mostly carbon monoxide and hydrogen is diverted in pipe 51 together with power via 58 from E and water in pipe 56, for use in the said Electrolyzer-Fuelcell combination detailed on FIG. 2.

The balance of the stream out of F is divided into two unequal parts for reasons stated; a major portion being extracted, quantitatively as outlined hereinafter, directed to catalytic methanation in unit J arriving at synthetic natural gas, micellaneous hydrocarbons or $S0_2$ free motor fuel, etc.

The remaining lesser portion of the stream out of F is diverted, together with oxygen, to gasturbine-electric generator set G-1, electricity generated to control station E, discharging spent combustion products from gas turbine into gasifier A; thus completing a circuit of the closed circulatory system, repeated over and over again indefinitely if desired.

The above mentioned first stream portion out of F, accompanied by power and water, are required by Electrolyzer-Fuelcell combinations for electrolyzing water to oxygen and hydrogen, simultaneously generating electricity in intimately associated fuel cells, the latter discharging its partially spent gases to gasifier A, usefully employing some therein.

Oxygen liberated from water by said Combinations is directed for oxidation purposes in A and G while hydrogen enriches the said extracted major gaseous portion diverted to J, the substantial hydrogen quantities remaining, becoming available for secondary energy generation, etc.

In a more detailed description of my disclosure as well as its best mode as contemplated by the inventor, I select arbitrarily as a first step in the continuous process, the place in the disclosure embodiment wherein the synthesis gas stream is unceasingly replenished maintaining continuity of processing and output. That place is the gasifier A receiving fossil fuel which may be pulverized coal, or oil-shale, or petroleum oil via pipe 2, oxygen arriving in pipe 3, superheated steam in pipe 4, while partially spent fuel cell gases from said Electrolyzing-Fuelcell Combinations, together with spent combustion products out of gasturines in G-1 G-2, etc. are discharged via pipe 1-all that into A; said combination of fuel values, oxygen and steam insuring exothermic reactions to synthesis gas at slagging conditions, slag-ash formed flowing to a cooling pool and disposal.

An additional item added to A is a reactant for nitrogen and its oxides present in synthesis gas being made in the gasifier, the reactant will be clean sand injected via pipe 6, being largely quartz, its silicon melting at 2500° F. forms with said nitrogen and hydrogen, silicon nitrimide $Sm_2N_3H$ an inert powder, likely disposed of with slag-ash, or if not shedded from the stream and ejected in the next unit B as below.

The excessively hat synthesis gas stream issuing from gasifier A via pipe 5 will have a composition thus:

| | |
|---|---|
| Carbon monoxide | 34% |
| Hydrogen | 37% |
| Carbon Dioxide | 16% |
| Unreacted Superheated Steam | 2 % |
| Sulphur Dioxide and $H_2S$ | 3% |
| Silicon nitrimide and ash | 8% |
| | 100% |

The stream is distributed from A through pipes 5 into the heated chambers of B, an enclosure into which air is denied entry; built of concrete, steel and heat resisting materials conforming to accepted elevated furnace designs.

It is divided internally into a plurality of connected chamber groups, each group having a heated chamber into it a hot stream portion from A via a pipe 5 is injected and directed upwardly, together with a connected contiguous, chamber in each group, which is enlarged in its crossectional area relatively to the crossectional area of a similar enlarged chamber of the preceding chamber group; the stream being directed downwardly in enlarged chambers 8, 10, 12 and 14 while upwardly in chambers 7, 9, 11 and 13 in a B as drawn on FIG. 1 herewith; residual precipitated ash is shedded in enlarged cooler chambers caused by decreased stream velocities therein when descending in the enlarged chambers; said shedded ash is collected is hoppers and therefrom carried away from disposal in water-cooled conveyor 15 to pipe 16, all as illustrated in the drawing.

Accompanying the hot stream portions injected into the heated chambers as above, will be oxidizable carbonaceous matter, by way of example, fossil fuel from source shown in drawing sheet no. 1, advancing via pipes 2, 17 and 18, or if available coke from source 19 moving forward in pipes 20, 17 and 18, one or the other of these arriving through said pipes 18 joining with hot synthesis gas portions in pipes 5, together injected, in manner shown by item 21, into lower parts of heated chambers 7, 9 and 11; the combination of adequate heat at elevated temperatures supplied by said hot gas portions on the one hand, and above carbonaceous matter or coke on the other hand, effects endothermic reactions between not-wanted carbon dioxide carried by the stream and said added carbon element to carbon monoxide; as well as similar reactions between unreacted steam (water), also carried by the stream to carbon-monoxide and hydrogen, these newly made ingredients joining the stream in place of reacted carbon dioxide and steam.

It will be advantageous to heat the last heated chamber 13 to the temperature level required to effect the said endothermic reactions, by way of electrical heater 22 energized from E via conductors 23, rather than by a portion, of hot synthesis gas as for chambers 7, 9 and 11, thereby avoiding addition of more carbondioxide-contaminated synthesis gas and unreacted steam.

Installation of steam curtains in heated chambers 9 and 11 similar to that shown for chamber 7 on their internal peripheries will effectively protect chamber surfaces from deposits during passage of the carbon carrying stream when carbon compounds pass through their adhesive stages to temperatures about 1000° F. Provision is made for burning out unavoidable deposits on surfaces by injecting air or oxygen via pipe 24, products of combustion via stack 25, controlled by valve 26.

Process steam for gasification in A as well as for steam curtains in heated chambers of B will be made from water in pipes 27 and 28 passing through shaft of water-cooled hot ash conveyor 15 and therefrom through a series of coils 29 installed in lower parts of the enlarged chambers 8, 10, 12 and 14 of unit B absorbing heat in its travel thus becoming steam, then via pipe 29 to steam curtains as well as in pipe 29 to superheater via pipe 4 and distribution unit in A for gasification of fossil fuel in combination with oxygen from pipe 3 and 60 originating in Electrolyzer-Fuelcell-Combination described in detail hereinafter.

It will be noted that installation of heat absorbing steam generating coils 29 in enlarged chambers of B will have a secondary effect in that absorption of heat by the coils will cool gaseous stream contacting same, thus increasing temperature differences between heated and enlarged contiguous cooler chambers of the plurality of chamber groups in B; such temperature differences in turn augmenting differences in stream densities when passing consecutively through the succession of heated and enlarged cooler chambers; generating thereby convection currents inducing a change of speed of stream flow, the construction and operation of unit B being thereby a thermosyphonic pump, a contribution to the economic efficiency of my disclosure.

The thereby reconditioned synthesis gas stream issuing from B via pipe 30, will be quite hot, only slightly below the temperature level needed to effect endothermic reactions at a rapid rate, about 1500° F.; the stream out of B having a composition approximately thus:

| | |
|---|---|
| Carbon monoxide | 46% |
| Hydrogen | 46% |
| Carbon dioxide (atolerable) | 2% |
| Unreacted Steam | 1% |
| Sulphur dioxide and $H_2S$ | 3% |
| Dust, etc. | 2% |
| | 100% |

The heat values carried by the stream in pipe 30 are usefully employed in heat exchanging steam boiler unit C making steam including superheated steam by item 31, such issuing in pipe 32 to heat engine — electric generator set unit D, electrical energy produced via conductor 33 to control unit E distribution, while spent steam out of its heat engine is directed in pipe 34 to a condenser the condensate therefrom via J absorbing exothermic reaction heat therefrom and then back to C for reuse as boiler feed.

The gaseous stream, having been cooled by heat exchange in C, is then directed in pipe 36 to unit F, first rid it of unreacted steam, hydrogen sulphide and ash-dust, too fine in particle size to be shedded in unit B. That is effected by scrubbing the stream by water-jets out of pipe 37, thus condensing the unreacted steam to water, wetting the ash-dust to dust-water droplets, while added water to hydrogen sulphide forms sulphuric acid. Passing the thus "scrubbed" stream through a cyclone, old to the art, outseparates said contaminants, disposed of with ash from B.

To rid the stream of as much as possible of the very-much-not-wanted sulphur dioxide, the thus contaminated stream is passed through enclosed reaction spaces occupied by relatively dense accumulations of continually renewed pulverized limestone injected via pipe 39 to unit F, whereby the reaction takes place $$CaCo_3 + SO_2 \rightarrow CaSO_4 + CO$$

the mixture of unreacted $CaCO_3$ and $CaSO_4$ separated to disposal by mechanical means old to the art, each recovered to useful employment or to disposal, while CO joins the stream, enriching it.

The relatively clean $CO + H_2$ stream issuing from F may have extracted from it the item 1 or item 2 below, one or both:

1—a gaseous portion of $CO + H_2$ fuel gas via pipe 51 plus electrical energy in leads 58 from E and water in pipe 56; all to Electrolyzer-Fuelcell Combinations illustrated on FIG. 2.

2—a gaseous portion through pipe 43 for useful employment, including burning it in a steam boiler furnace producing steam for a heat engine-electrical energy generating set.

The balance of the stream out of unit F, via pipe 40 is then directed to division area shown on FIG. 2 for division therein into two unequal parts; the renewal of the stream without cessation making it necessary to extract continuously from the stream, equivalent masses to those absorbed by the closed circulatory system, to maintain mass equilibrium therein, avoiding indigestion as well as assuring continuity of processing and output. The extracted part I call *the major stream portion;* while the balance continuing to flow through the remainder of the system to gasifier unit A I call *the lesser stream portion.*

A—the said major stream portion is extracted by pump 41 and directed in pipe 42 to unit J for separate processing therein as outlined below, its mass being the summation of the masses of fossil fuel, steam oxygen, hydrogen, carbon compounds or coke, absorbed by the stream; but minus the outseparated and ejected slag, ash, silicon nitrimide, sulphur dioxide, hydrogen sulphide; the major portion comprising a relatively large quantity compared to the lesser stream portion; the useful products of separate processing in unit J includes by way of example:

Synthetic natural gas made by passing the enriched carbon monoxide and hydrogen gas stream over iron-nickel catalytic surfaces thereby upgrading its heating value to about 900 btu per cub. ft, in a method now old to the art, effecting the exothermic reaction: $CO + H_2 \rightarrow CH_4 + H_2O$; liberating 95000 btu per lb. mole at 700° F.; much of said heat being recovered by heat exchange with installed coils containing condensate via pipe 35 to unit C. Hot reaction water may also be recovered to unit C.

The required enriching element hydrogen in the above reaction is made, along with oxygen in the Electrolyzer-Fuel cell Combination described hereinafter, being supplied therefrom in pipe 63 to pump K, a relatively small part in pipe 64 to unit J adequately enriching the extracted major stream portion in pipe 42 together flowing over the catalytic surfaces effecting above reaction to synthetic natural gas available for use via pipe 69 to fuel gas enrichment in pipe 47 and/or to a pressure pump for distribution in competition with natural gas for conventional power plants, etc.

B—the remaining lesser stream portion out of pipe 40 and the division area is diverted by pump 44 and directed in pipe 45 and on being joined by oxygen in pipe 61, reacts in combustion chamber 48 for gas turbine-electricity generating set, unit G-1, the electrical energy thus produced via conductor 49 to control unit E for distribution. It will be noted that fuel gases in pipe 45 may be enriched with synthetic natural gas from unit FIG. J via pipe 47 improving efficiency and energy output of gas turbine-electricity set G-1, discharging its partially spent combustion products plus that from G-2 as well as from the fuel cell part of the Electrolyzer-Fuel cell Combination into pipe 1 to the gasifier unit A; thereby completing a circuit of the closed circulatory system, a characteristic feature of my invention, such circuits being repeated indefinitely.

The hereinbefore disclosed electrical energy and material conversion system requires substantial quantities of oxygen and hydrogen made available for oxidation of fossil fuels and combustible materials injected into gasifying unit A as well as for oxidation of fuel gases in combustion chambers for gas turbines in units G-1 and G-2 while hydrogen is needed to enrich the extracted major stream portion for effective reactions in unit J and for other useful employment.

The above requirements are fully met at new low unit costs by my novel Electrolyzer-Fuel cell Combinations receiving electrical energy via conductors 58, fuel gases in pipe 51 and water in pipe 56 is illustrated on drawing sheets nos. 1 and 2 herewith. Each of the plurality of said Combinations I call units $H\text{-}1_2$ $H\text{-}2_2$ etc. on the drawings, consisting of a duality of electrolyzer passages in union with a fuel cell, thus:

Utilizing the said fuel gas portion in pipe 51 from activities illustrated on drawing FIG. 1 it is pumped and ionized in unit 52 shown on FIG. 2 and directed through fuel gas-electrolyte passages 53 of the fuel cell parts of said Combinations, therefrom discharging via pipes 54 into header pipe 55 leading partially spent fuel gas from fuel cell electricity generation to pipe 1 and gasifier A.

As illustrated, water from source via pipe 56 is caused to maintain levels in water reservoirs while immersing electrolyzing electrodes therein, energized via conductors 58 from control unit E, whereby oxygen and hydrogen rise in separate passages $O_2$ and $H_2$ shown on drawing FIG. 2. Therefrom oxygen flows upwardly in their passages of units H-1, H-2, etc, issuing into pipes 59 and header 60 leading to pipe 3 and unit A as well as through pipe 61 to combustion chamber 48 of gas-turbine-electric generator set G-1. Similarly hydrogen flows upwardly in passages $H_2$ issuing into pipes 62 and header 63 distributed therefrom via pump K to unit J enriching the major stream portion therein, while most of the hydrogen liberated becomes available as output.

Direct conversion of fuel values to electricity via fuel cells in said Combinations is effected by continuous migration of oxygen and hydrogen ions through porous electrodes separating the fuel gas-electrolyte passage 53 from the $O_2$ and $H_2$ passages, the porous electrodes being connected to each other via control unit E, thus forming an exterior electric circuit. The migrated oxygen ions react chemically with similarly migrated hydrogen ions meeting in the fuel gas-electrolyte passage 53, or what is more likely as well as more effective, the migrated oxygen ions will react with the carbon monoxide and/or hydrogen parts of said fuel gas flowing in passage 53, exothermic reactions resulting liberating electrical charges from said migrated oxygen ions as well as from fuel gases in 53 having been ionized in unit 52 releasing electrons to one or the other of the porous electrodes and therefrom through the external circuit 57 to or from unit E, activities stated generating a unidirectional electric current, contributing much to energy requirements for electrolysis of water.

It will be noted that fuel cells as such have a high theoretical efficiency not being subject to the Carnot Limitation. However, unaided ion migration is at best relatively slow and sluggish, making output correspondingly low. To augment reactivity and migration of ions I propose the following methods and means:

a—Fuel cell performance will be invigorated by directing properly oriented electromagnetic waves and accompanying radiation generated in apparatus I call unit L, alongside units H-1, H-2 etc., shown on drawing FIG. 2 and energized from powerline 58, production methods for such waves being old to the art.

Said advancing electromagnetic waves possessing momentum impinge with appreciable impact on the migrating ions having excessively minute-masses thus increasing migration speeds as well as numbers and masses of ions transported through the porous electrodes; engaging and reacting with more hydrogen and carbon monoxide entities moving through the fuel gas-electrolyte passage 53, liberating more electrical charges and electrons to external circuit 57, improving fuel cell energy output correspondingly. See my U.S. Pat. No. 3,847,670.

b—Activities are also intensified by installation of secondary electrodes 66 and 67 in the hydrogen and oxygen passages improving transport of ion-charges and electrons between primary porous electrodes "e" and secondary electrodes 66 and 67 and therefrom to and from electric circuit 57, again inproving fuel cell energy output. See my U.S. Pat. No. 3,751,302 about secondary electrodes. Also my U.S. Pat. No. 3,493,436 about electromagnetic flux.

c—Performance is additionally improved by extracting a portion of oxygen rising in its passage by a pump and then reinjecting the portion at a lower part of the oxygen passage, ionizing the portion by passage through ionizing unit 68 producing adequate ions for migration through porous electrode to passage 53.

d—Migration of ions from $O_2$ and $H_2$ passages to the fuel gas-electrolyte passage 53 will be additionally invigorated by maintenance of a higher pressure in the $O_2$ and $H_2$ passages relatively to the pressure in passage 53, e—Said porous electrodes at boundaries between fuel gas-electrode passage 53 and the oxygen and hydrogen passages, will need to be replaced at intervals because corrosion closes pores or perforations permitting the passage of ions. Plant operations will provide for the insertion of replacing electrode in apertures provided, avoiding production stoppage.

To repeat, it will be noted that above outlined Electrolyzing-Fuel cell combination liberates oxygen and hydrogen from water by expenditure of power, while simultaneously the same liberated oxygen and hydrogen are usefully employed to generate substantial energy values together with new water by exothermic reactions of liberated oxygen and hydrogen — all that is effected in the same apparatus at the same time, the two separate operations contributing material or energy to each other while benefiting the combination; obviously something new, novel and valuable.

For excessive oxygen requirements by large output power generating and/or synthetic natural gas producing plants over and above that the above outlined Electrolyzer-Fuel cell Combinations are capable of making available; a cryogenic air liquefaction unit liberating tonnage oxygen from air at much higher unit costs may be necessary, supplying oxygen to unit FIG. A, etc. via pipe 72.

It will be noted that my invention is capable of meeting demand for emergency power within limits by adding air via pump 71 to the oxygen stream in pipe 3 leading to gasifier unit A. That will unavoidably contaminate correspondingly the synthesis gas made therein with additional nitrogen, met by adding more quartz sand via pipe G, forming with its silicon said nitrogen and hydrogen present, silicon nitrimide an inert powder; carried off with slag or shredded with ash in unit B, all as before.

Sumarizing results of activities described and illustrated hereinbefore it will be noted that output of an embodiment of my disclosure comprises net available electricity from control unit E, miscellaneous hydrocarbon via pipe 69 and excess hydrogen gas in pipe 65, shown at right hand margin of drawing FIG. 1.

The adjunct to my invention the Electrolyzing-Fuel cell Combinations liberates oxygen and hydrogen from water at low unit costs, put to advantageous use in a manner described hereinbefore and illustrated on drawing sheet no. 1.

The above outlined methods and means gives to electrical energy generation together with simultaneous valuable product manufacture, an economy advantage over and above related conventional processes as well as an operating flexibility, not to be found in comparable electricity dominated systems; while at the same time definitely avoiding befoulment of the environment with obnoxious and biologically injurious discharges, my invention being also new to the art useful and operative.

Having described and illustrated my invention entitled: "Converting fossil fuels and liberated water constituents to electrical energy, synthetic natural gas or hydrocarbons and hydrogen while avoiding befoulment of environment," I claim:

1. A method for generating electrical energy while continuously producing a continuous stream of fuel gas consisting of principally hydrogen and carbon monoxide, made from oxidized fossil fuel and water constituents, in a process taking place in a closed circulatory system repeated over and over again indefinitely; substantial excess portion of said fuel gas being of necessity continuously extracted from the unceasingly renewed stream to maintain its mass equilibrium and continuity of processing, the extracted portion diverted for manufacture of a line of hydrocarbons in quantity; said method effected in steps comprising:

1—injecting uninterruptedly coal or other fossil fuel in suspension by oxygen and superheated steam into a gasifing unit, producing therein a continuous stream of synthesis gas at elevated temperatures above the fusion point for ash, the thus liquified slag-ash to a cooling pool for disposal, 2—directing the hot synthesis gas stream issuing from the gasifier to a stream reconditioning enclosure denying air entry, divided internally into a plurality of chamber groups, each group having a heated chamber and a connected contiguous cooled chamber, the stream impelled to flow consecutively through the succession of connected chamber groups, upwardly in the heated chambers and downwardly in the cooled chambers, from entrance to exit of the enclosure, 3—heating the heated chambers by portions of the hot synthesis gas stream issuing from the gasifier and directed upwardly in the heated chambers, while the cooled chambers, enlarged in crossectional areas relatively to the crossectional area of the cooled chamber of the preceding chamber group, are cooled by cooling coils absorbing heat from descending hot streams when contacting said coils, thus cooling the streams and chambers, 4—inducing the stream to flow through the plurality of connected chamber groups to enclosure exit by said heating and cooling of the contiguous connected chambers; the relatively higher temperatures of the stream flowing upwardly in the heated chambers compared to the somewhat lower temperatures of the stream descending in the enlarged, cooled chambers, give rise to differing densities of the stream when inhabiting the two chambers, thereby developing a plurality of connection currents impelling the stream to advance to exit of the enclosure, 5—converting not-wanted carbon dioxide carried by the synthesis gas stream to carbon monoxide, the reaction involved effected by addition of oxidizable carbonaceous material, for example coke, to the hot synthesis gas portions when injected into the heated enclosure chambers, endothermic reactions between stream-contaminating-carbon dioxide and the carbon element in the said added carbonaceous material, results in carbon monoxide when in the presence of adequate heat at a temperature level above that required for effecting the said endothermic reaction, such heat being supplied by the hot synthesis gas-portions heating the heated chambers to elevated temperatures, the thus produced carbon monoxide joining and enriching the stream flowing through the stream reconditioning enclosure, 6—shedding of ash and other particles from the stream flowing through the enclosure is effected as a result of decreases in stream velocities taking place when stream descends in enlarged cooled chambers of the chamber groups, thereby shedding ash and other particles from the stream, each of the successive cooled chambers of the plurality of chamber groups being progressively enlarged in volume via increased crossectional areas, as the stream flows toward enclosure exit, the thus shedded ash particles being collected and ejected from the enclosure for disposal, 7 — recovering substantial heat energy values from the relatively hot stream issuing from the stream reconditioning enclosure after conversion activities therein, by passing the stream through a heat-exchanging steam boiler making steam for a heat engine driving an electric generator, generating electrical energy to a control unit for distribution to useful employment as may be desired; while the thereby cooled stream issues from the steam boiler; available for additional treatments including:

8 — ridding the stream of various not-wanted ingredients including unreacted steam and dust particles too small to be shedded in the manner of steps 5 and 6, as well as hydrogen sulphide; elimination of these ingredients effected by scrubbing the stream with water jets, thus condensing the unreacted steam to water, wetting the fine dust to water-dust-droplets, while hydrogen sulphide, soluble in water, becomes sulphuric acid; the gaseous stream now carrying thus-treated-not-wanted-ingredients is passed through a rotating cyclone, old to the art, outseparating and ejecting from the stream the thus-treated-not-wanted ingredients for disposal, 9 — dividing the stream, now cooled and freed from several undesirable contaminants, in a stream division area into two unequal stream parts, it being obvious that due to continual renewal of the stream in the gasifier plus additions to it in other units; a major portion of the stream substantially equal in mass to the sum of the masses of ingredients absorbed by the stream during said processing must of necessity be continuously extracted from the stream of maintain continuity of processing in the closed circulatory system, the extracted major portion of the stream being diverted to manufacture of a line of hydrocarbons elsewhere, 10 — directing the remaining lesser portion of the divided stream, together with adequate supplies of an oxidant, to operative gas turbine-electric generator sets, generating electrical energy to the said electricity control unit for distribution as may be desired; while simultaneously 11 — augmenting the masses of the continuously renewed reactants making synthesis gas in said gasifying unit by adding the spent, quite hot, gas-turbine discharges to the gasifier, thereby closing a circuit of the closed circulatory system, repeated over and over again indefinitely if desired, 12 — resulting in generation of electrical energy for useful employment desired, while producing a continuous stream of fuel gas consisting of principally hydrogen and carbon monoxide available for uses desired, having their origin in fossil fuel, water constituents and oxidants.

2. The claim as claimed in claim 1 having in addition the steps effecting elimination of not-wanted nitrogen and its oxides from the synthesis gas of step 1 made in the gasifier unit; having their origin in fossil fuel used and/or from air when air is used as an oxidant for fossil fuel therein, said steps comprising:

1 — injecting small grained clean quartz-sand to the gasifier unit, while production of synthesis gas at temperatures well above the fusion point of fossil fuel ash in proceeding continuously, silicon in the quartz-sand melting at temperatures well below the temperatures developed in the gasifier, the melted silicon then 2 — reacting with nitrogen and its oxides present in the synthesis gas as well as with hydrogen also present therein, producing thereby silicon nitrimide, an inert powder, $Sn_2N_3H$, 3 — carrying off for disposal portions of the thus produced silicon nitrimide by the liquified slag-ash, together with portions of sulphur and carbon dioxide contaminants, while remaining portions of the silicon nitrimide powder will be 4 — shedded from the synthesis gas stream when processed in the stream reconditioning enclosure as hereinbefore described for discarding of ash and other particles from the stream; thereby eliminating nitrogen and its oxides from the synthesis gas stream.

3. The claim as claimed in claim 1 having in addition steps effecting elimination of not-wanted sulphur dioxide from the cooled stream issuing from the heat exchanging steam boiler of step 7, the elimination steps comprising:

1 — directing the contaminated stream into one or the other of a duality of combinations of reaction enclosures arranged in a connected series of units, each enclosure being occupied in full by pulverized calcium carbonates in suspension while air is denied entry into the enclosures, 2 — effecting reactions between the particles of calcium carbonates on the one hand and sulphur dioxide carried by the stream on the other hand, arriving at calcium sulphate and carbon monoxide 3 — recovering the thereby liberated carbon monoxide, caused to join and enrich the stream, 4 — alternating said injections of the stream into one or the other of a duality of enclosure combinations, which becomes necessary to do periodically in view of progressive deterioration of the calcium carbonate as a reactant when reacting with the sulphur dioxide stream contaminant; said alternations providing opportunities, without having to interupt sulphur dioxide elimination, to separate and recover much unreacted calcium carbonate for reuse, adding fresh calcium carbonate, while also separate and recover the reacted calcium sulphate, this becoming available as gypsum or alabaster for sale.

4. The method simultaneously effecting electrolysis of water liberating oxygen and hydrogen separately by expenditure of power from a source, while using portions of the same liberated oxygen and hydrogen to activate fuelgas-hydrogen-oxygen fuel cells generating electricity, which may then be diverted to contribute to the power requirements for said electrolysis of water, the result being that the energy needed to be withdrawn from said power source for said purpose is thereby correspondingly reduced; the activities in the fuel-cell extrolyzer combination, effecting the said simultaneous expenditure and generation of power process; comprises the following steps:

1 — supplying water continuously from a source maintaining levels in acidified water reservoirs in which electrolyzing electrodes are immersed and adequately energized from a source of power thus causing ionized oxygen and hydrogen to rise in separated passages denying air entry, and therefrom directed to useful employment as desired, 2 — injecting fuel gases from a source, consisting principally of carbon monoxide and hydrogen, caused to rise uninteruptedly through a passage inserted between the two separated oxygen and hydrogen passages, 3 — separating the fuel gas passage from each of the oxygen and hydrogen passages by electricity conducting porous electrodes having numerous minutely small apertures capable of passing oxygen and hydrogen ions through them, the electrodes connected to each other via an electrical control station forming a circuit 4 — inducing portions of the oxygen ions, rising in its passage, to migrate, impelled by chemical attraction, from its passage, through said apertures in the porous electrodes, to the fuel gas passage; reacting therein with its hydrogen constituent forming steam; and/or with its carbon monoxide to form carbon dioxide, the reactions 5 — liberating electrical charges carried by reactants ions, which in turn, releases their electrons to electricity conducting electrodes, generating a unidirectional electric current made available via control station in exterior circuit, 6 — directing the liberated oxygen in quantity, less portions consumed by fuel cell activities, to many uses; while liberated hydrogen is directed separately to useful employment, including secondary energy generation.

Thereby quantities of oxygen and hydrogen gases are made available by novel methods and means having substantial economic advantages over conventional water electrolysis processes heretofore in use.

* * * * *